US006713976B1

(12) United States Patent
Zumoto et al.

(10) Patent No.: US 6,713,976 B1
(45) Date of Patent: Mar. 30, 2004

(54) BEAM ACCELERATOR

(75) Inventors: Nobuyuki Zumoto, Tokyo (JP); Takahisa Nagayama, Tokyo (JP); Yuko Kijima, Tokyo (JP); Yoshihiro Ishi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/417,218

(22) Filed: Apr. 17, 2003

(30) Foreign Application Priority Data

Oct. 17, 2002 (JP) ..... 2002-302684

(51) Int. Cl.[7] ..... H05H 11/00
(52) U.S. Cl. ..... 315/500; 315/504; 315/507
(58) Field of Search ..... 315/500, 507, 315/506, 501, 504

(56) References Cited

U.S. PATENT DOCUMENTS 5,811,943 A * 9/1998 Mishin et al. ..... 315/505

OTHER PUBLICATIONS

F.T. Cole, "Electron Model Fixed Field Alternating Grandient Accelerator", Review of scientific instruments, vil.28, #6 (1957), pp. 403–420.

* cited by examiner

*Primary Examiner*—David Vu
(74) *Attorney, Agent, or Firm*—Leydig, Voit & Mayer, Ltd.

(57) ABSTRACT

A high performance beam accelerator in which accelerating voltage may be increased by applying a high excitation frequency to the accelerator core and controlling heat generation. The beam accelerator includes an annular hollow vessel with an annular passage, fixed magnetic field generators generating magnetic fields for deflecting and guiding a charged particle beam into an orbit, an accelerating gap for inducing an accelerating electric field, and an accelerator core for generating the accelerating electric field via the accelerating gap by changing magnetic state in accordance with electromagnetic induction. Injection to ejection of charged particles is completed within one cycle of the excitation frequency applied to the accelerator core. The accelerator core includes wound multiple layers of a ribbon-shaped soft magnetic alloy, 50 $\mu$m or less in thickness, and having a saturation magnetic flux density of 1 Tesla or more.

8 Claims, 6 Drawing Sheets

FIG. 9

| | WORKING SATURATION MAGNETIC FLUX DENSITY | LOSS (2kHz、1T) |
|---|---|---|
| | (T) | (W／kg) |
| SILICON STEEL PLATE (100μm) | 1 | 75 |
| SILICON STEEL PLATE (50μm) | 1 | 50 |
| FERROUS AMORPHOUS | 1 | 40 |
| FERROUS NANO-CRYSTAL | 1 | 3 |
| FERRITE | 0.3 | *** |

BEAM ACCELERATOR

BACKGROUND OF THE INVENTION

1. Field of the Invention

The present invention relates to a beam accelerator for generating high-energy charged particle beams or high-energy X rays used in cancer treatment, sterilizing and the like, and in particular, relates to an FFAG-type, circular, magnetic induction (betatron) accelerating beam accelerator which uses a fixed magnetic field to deflect charged particle beams.

2. Description of the Related Art

Beam accelerators accelerate charged particles such as electrons and the like. These accelerated charged particles irradiate an X ray conversion target of copper, tungsten, and the like to generate X rays, and cancer treatment, sterilizing and the like is performed by irradiating affected areas with the X-rays. The beam accelerator of the present invention is an FFAG (Fixed Field Alternating Gradient) accelerator using a fixed magnetic field to deflect charged particle beams, and has a small size and a high output. The only extant sample of an electron accelerating FFAG beam accelerator is the MURA (Midwestern Universities Research Association) prototype in the United States (for example, see Non-patent Publication 1)

Output voltage limiting conditions of conventional FFAG beam accelerators will be described. When an electron beam current is increased, efficient acceleration becomes problematic because the electron beam diverges in a region where it cannot be accelerated sufficiently. In order to control this divergence, accelerating voltage may be increased and acceleration performed at an earlier point in time to make a high energy beam prior to divergence. That is, the accelerating voltage may be increased proportional to the time-variance of the magnetic flux. In order to do this, the exciting frequency applied to the accelerator core must be increased.

Non-patent Publication 1

F. T. Cole et al., THE REVIEW OF SCIENTIFIC INSTRUMENTS, volume 28, number 6, (USA), the American Institute of Physics, 1957, p. 403–420.

In FFAG betatron accelerating beam accelerators, the exciting frequency applied to the accelerator core has been limited to a conventional 100 Hz. This is due to the material used in the accelerator core. For example, although a silicon steel plate of a 100 $\mu$m thickness, used in a conventional accelerator core, has a high saturation magnetic flux density, core loss and generated heat are large. Thus, operation at a high exciting frequency (1 kHz or more) is difficult.

A variation in the magnetic flux of an inner portion of the core is dependent upon the saturation magnetic flux density which, in turn, depends on the material and the cross sectional core thickness. When a core material of a high saturation magnetic flux density is used, the cross sectional core thickness may be made smaller, the (amount of) material may be reduced and the apparatus may be made smaller. However, in material of high saturation magnetic flux density, generally, core loss and generated heat are large. As a result, there is a problem in that the cross sectional thickness of the core and the size of the apparatus are increased.

In an FFAG betatron accelerating beam accelerator such as above, in a case where the exciting frequency applied to the accelerator core is 1 kHz or more, from the standpoint of temperature increase, a material of high saturation magnetic flux density and core loss must be used and there is a problem in that the size of the accelerator core is increased. On the other hand, when a small size is important and a high saturation magnetic flux density material (silicon steel plate of a 100 $\mu$m or greater thickness and the like) is used, operation must be performed with an exciting frequency of less than 1 kHz applied to the accelerator core and there is a problem in that sufficient output cannot be obtained.

SUMMARY OF THE INVENTION

The present invention aims to solve the above problems and an object of the present invention is to provide a high performance beam accelerator in which accelerating voltage may be increased by making an exciting frequency applied to the accelerator core a high frequency and controlling heat generation of an accelerator core. Moreover, another object of the present invention is to provide a beam accelerator which is low cost and small in size.

According to one aspect of the present invention there is provided a beam accelerator including an annular hollow vessel formed with an annular passage inside through which passes a charged particle beam. Fixed magnetic field generating means for deflecting the charged particle beam and guiding the charged particle beam into an orbit in the annular passage is provided in plurality along a circumferential direction of the annular hollow vessel. An accelerating gap for inducing an accelerating electric field of the charged particle beam is provided at a predetermined position in the annular hollow vessel. An accelerator core for generating the accelerating electric field via the accelerating gap by changing a magnetic state of an inner portion in accordance with electromagnetic induction is provided so as to surround the annular hollow vessel.

Also, injection to ejection of charged particles is completed within one (1) cycle of an exciting frequency applied to the accelerator core.

Moreover, the accelerator core is prepared by winding in multiple layers a ribbon-shaped material of a soft magnetic alloy of 50 $\mu$m or less in thickness and of a high saturation magnetic flux density of 1 T or more. Thus, core loss may be controlled and the size of the accelerator core may be reduced. Consequently, the size of the beam accelerator may be reduced and the cost may be reduced.

BRIEF DESCRIPTION OF THE DRAWINGS

FIG. 4 is a perspective view showing a state of a winding wound around a pole piece (shoe) of the deflecting electromagnet in. FIG. 3;

FIG. 9 is a relational diagram comparing working saturation magnetic flux density and loss in several materials;

DETAILED DESCRIPTION OF THE PREFERRED EMBODIMENTS

Embodiment 1

Figure 1:
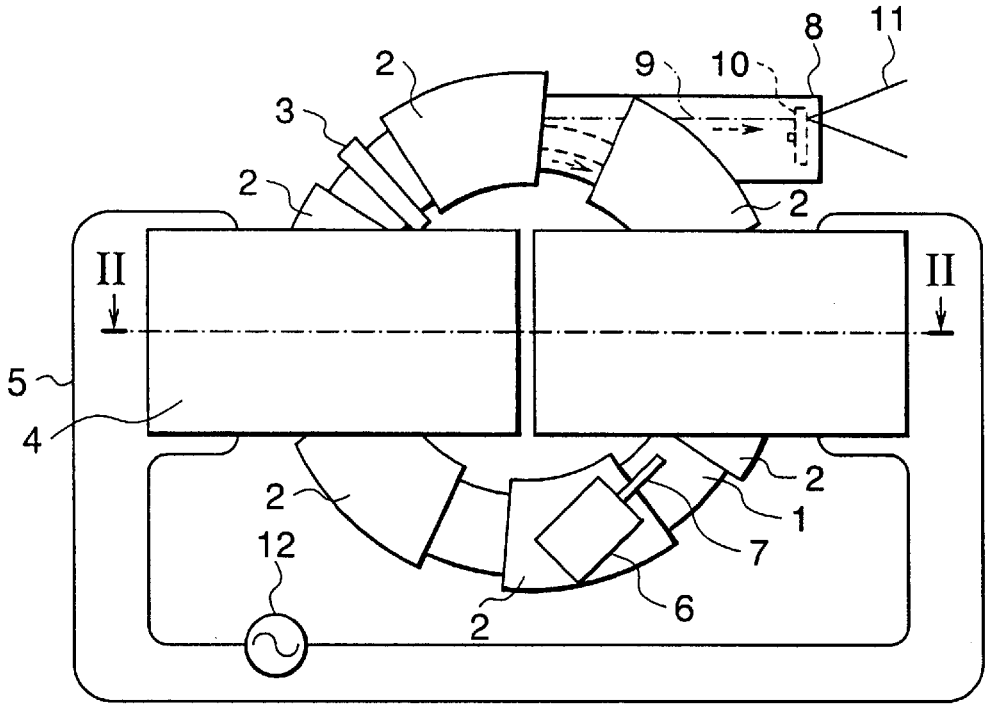
FIG. 1 is a top view of a beam accelerator according to Embodiment 1 of the present invention.
Figure 2:
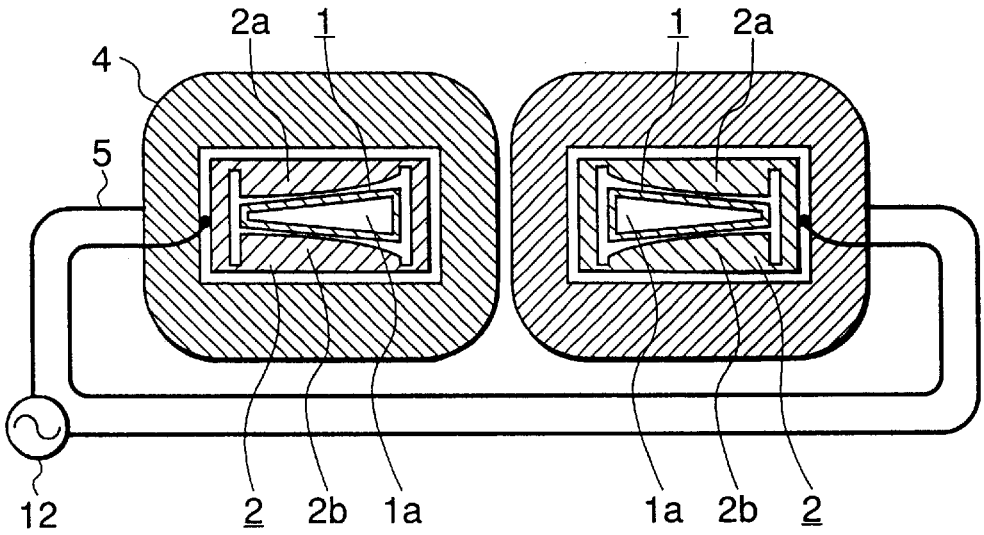
FIG. 2 is a cross-sectional drawing taken along line II—II of FIG. 1.
Figure 3:
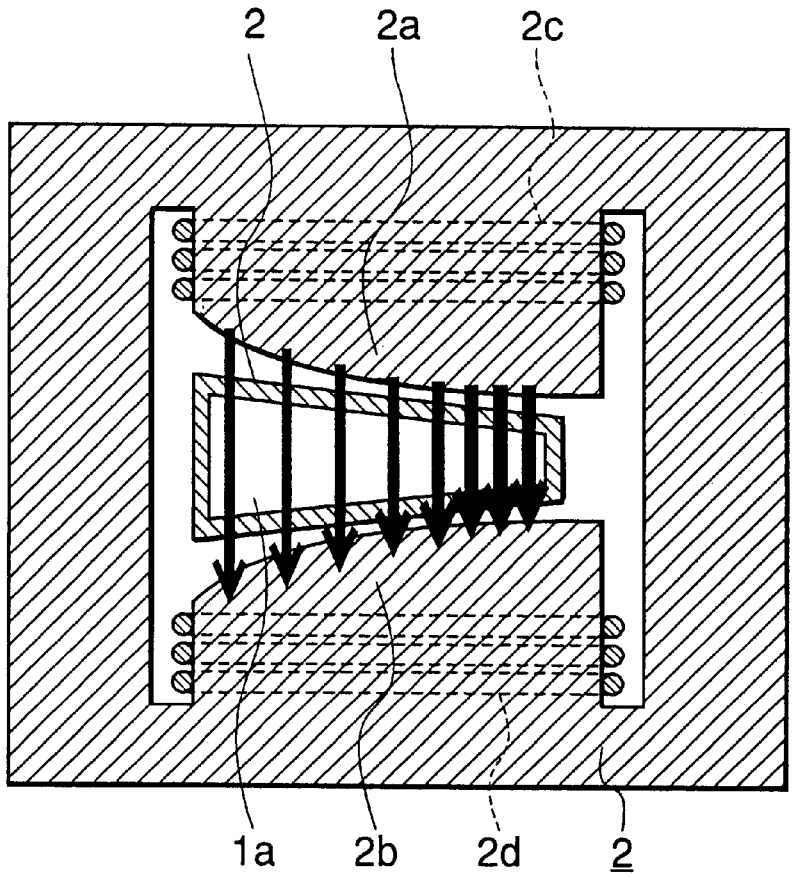
FIG. 3 is an expanded view showing magnification of a deflecting electromagnet portion in the cross-sectional drawing of FIG. 2.
Figure 4:
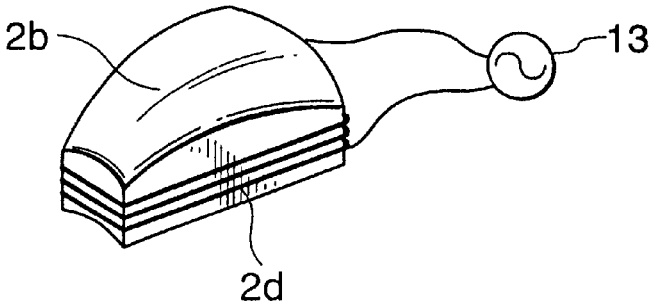
Figure 5:
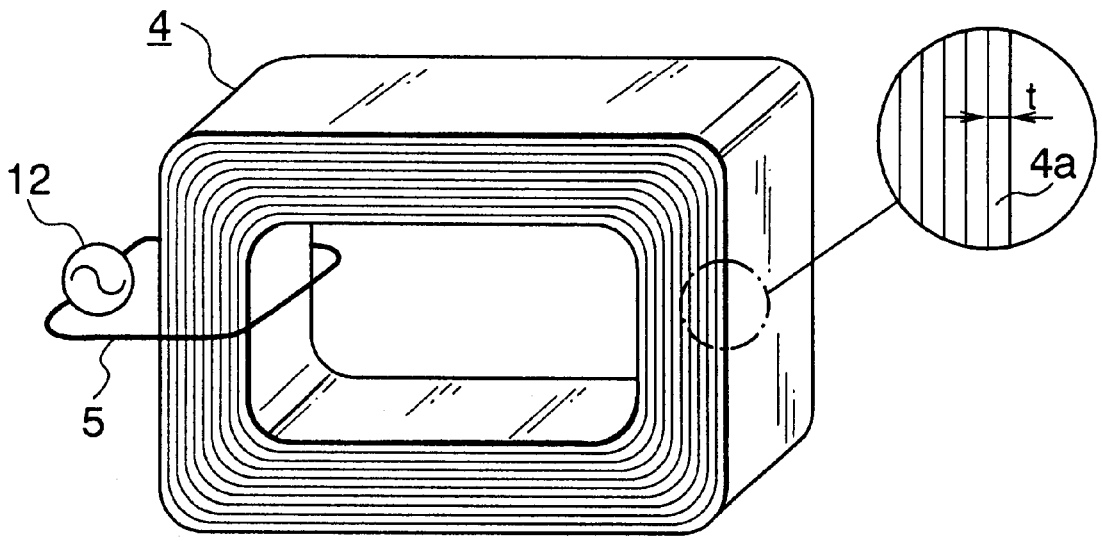
FIG. 5 is a perspective view explaining a prepared state of an accelerator core of the beam accelerator-of the First Embodiment in which ribbon-shaped, thin plates are wound in multiple layers.

FIG. 1 is a top view of a beam accelerator according to Embodiment 1 of the present invention. FIG. 2 is a cross-sectional drawing taken along line I—I of FIG. 1. FIG. 3 is an expanded view showing magnification of a deflecting electromagnet portion in the cross-sectional drawing of FIG. 2. FIG. 4 is a perspective view showing a state of a winding wound around a pole shoe (piece) of the deflecting electromagnet in FIG. 3. FIG. 5 is a perspective view explaining a prepared state of an accelerator core of the beam accelerator of the first embodiment in which ribbon-shaped, thin plates are wound in multiple layers.

A beam accelerator of the present invention is an FFAG, betatron accelerating beam accelerator. In FIGS. 1 and 2, a beam accelerator includes an annular vacuum vessel 1 forming an annular shape. The annular vacuum vessel 1 is prepared by welding stainless steel or iron thin plates so as to form a circular, annular shape and a cross-sectionally wedge-shaped enclosed space at an inner portion thereof, the enclosed space constituting an annular passage 1*a*, maintained at a vacuum, through which passes a charged particle beam. That is to say, the annular vacuum vessel 1 is an annular hollow vessel in which the annular passage 1*a*, for passing a charged particle beam, is formed in the inner portion thereof. The cross sectional shape of the annular passage 1*a* forms an approximate wedge in which a width (height) gradually becomes smaller from an inside diameter-side to an outside diameter-side along a radial direction.

In the annular vacuum vessel 1, six (6) deflecting electromagnets 2 are disposed at intervals, leaving a predetermined space, in a circumferential direction of the annular vacuum vessel 1. The six (6) deflecting electromagnets 2 are provided so as to surround, in various places, the annular vacuum vessel 1 of a wedge-shaped cross section. The deflecting electromagnet 2 includes two (2) pole pieces 2*a*, 2*b* which oppose each other from above and below at two (2) main surfaces of the annular vacuum vessel 1. The two (2) pole pieces 2*a*, 2*b* are disposed facing each other from above and below so as to sandwich the annular vacuum vessel 1, and are provided so as to gradually reduce a gap from an inside diameter-side to an outside diameter-side of the annular passage la along a radial direction. The two (2) pole pieces 2*a*, 2*b* are formed such that a cross sectional shape of a central portion is a convexo-curve so as to further reduce the gap at the central portion.

As shown in FIGS. 3 and 4, the two (2) pole pieces 2*a*, 2*b* are wound with a coil 2*c*, 2*d*, respectively. The two (2) coils 2*c*, 2*d* are wound in the same winding direction. Power is supplied to the coils 2*c*, 2*d* from a power source 13 and the deflecting magnet(s) 2 generate magnetic force as shown by the bold arrows in FIG. 3. When the gap of the pair of pole pieces 2*a*, 2*b* is increased, the magnetic flux density becomes coarse and the magnetic force becomes weak. Conversely, when the gap is reduced, the magnetic flux density becomes dense and the magnetic force becomes strong. That is, a magnetic field derived of the deflecting electromagnet 2, which is a magnetic field generating means, is a fixed magnetic field of a fixed strength gradually going from smaller to larger, in a radial direction, from an inside diameter-side to an outside diameter-side. Thus, the deflecting electromagnet 2 is a fixed magnetic field generating means. This fixed magnetic field is a magnetic field that is fixed regardless of revolution of the charged particles, and, besides the fixed magnetic field, another commonly used magnetic field is a variable magnetic field in which the field is shifted (changed) from the inner side to the outer side in synchronism with revolution of the charge particles. The deflecting electromagnet(s) 2 deflects a traveling direction of the charged particle beam a predetermined radius of curvature in accordance with the magnetic field. The deflecting electromagnet(s) 2 induces the charged particle beam into a predetermined orbit in the annular passage 1*a*.

Returning to FIG. 1, an accelerating gap 3 is provided in one location in the circumferential direction of the annular vacuum vessel 1 so as to enclose the annular vacuum vessel 1. In order to produce an accelerating magnetic field, a portion of the annular vacuum vessel 1 where the accelerating gap 3 is provided is divided at a surface which is perpendicular to the circumferential direction, and the dividing location is separated so as to include a predetermined gap. The accelerating gap 3 includes a short cylindrical member made of ceramic and the like, and the divided portion of the annular vacuum vessel 1 is sealed and joined by means of the cylindrical member so as to cover the gap. The accelerating gap 3 induces an accelerating magnetic field of the charged particle beam in a space inside the accelerating gap 3.

A pair of accelerator cores 4 is provided at two (2) locations in the circumferential direction of the annular vacuum vessel 1 so as to surround the annular vacuum vessel 1. The pair of accelerator cores 4 are disposed at a central portion of the annular vacuum vessel 1. As shown in FIG. 5, a ribbon-shaped material 4*a* of a soft, magnetic material, 50$\mu$m in thickness and having a high saturation magnetic flux density of 1 T or more, is wound in multiple layers to prepare the accelerator cores 4 of the present embodiment. A coil 5 for supplying a driving current from an accelerator core driving power source 12 is wound at the two (2) accelerator cores 4.

Figure 6:
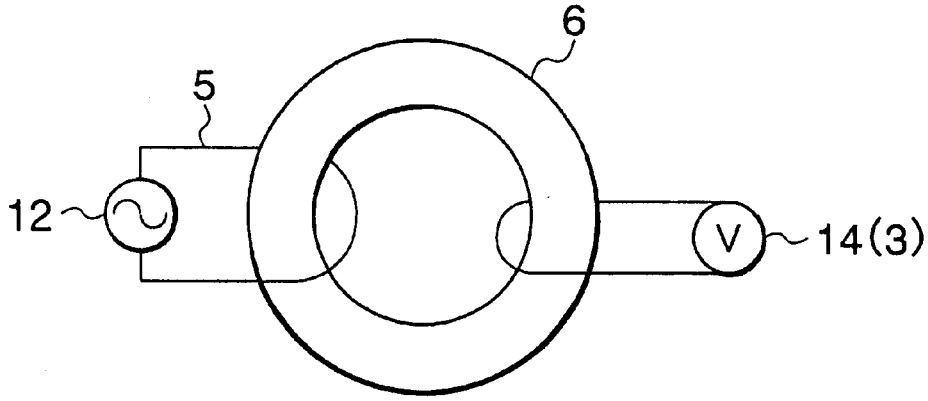
FIG. 6 is an electric system drawing explaining an electric circuit of the accelerator core of FIG. 5.

FIG. 6 is an electric system drawing explaining an electric circuit of the accelerator core of FIG. 5. A coil 5 for supplying an extremely strong alternating current from the accelerator core driving power source 12 is wound in one winding in each accelerator core 4. The two (2) accelerator cores 4 are electrically connected to the accelerating gap 3 via the annular vacuum vessel 1. In the accelerator core 4, an extremely strong alternating current is supplied from the accelerator core driving power source 12 and the magnetic state (flux) of the interior is changed. This change in the magnetic state produces an accelerating magnetic field in the accelerating gap 3 in accordance with the law of electromagnetic induction.

Returning to FIG. 1, an electron gun 6 for emitting electrons is provided at a predetermined position of the annular vacuum vessel 1. An electrostatic deflector 7 for guiding the emitted electrons into the annular vacuum vessel 1 is connected to the electron gun 6. On the other hand, in an electron beam outlet 8, an x ray conversion target 10 is disposed in a location where it will be impacted by a high-energy electron beam 9 of accelerated electrons. The high-energy electron beam 9 becomes x rays 11 by passing through the x ray conversion target 10.

Next, an operation of the beam accelerator will be described. Electrons generated by mean of the electron gun 6 are inducted into an orbit inside the annular vacuum vessel 1 by means of the electrostatic deflector 7. The electrons are deflected by the magnetic field generated by means of the deflecting electromagnet(s) 2 and are confined in orbit. The accelerating gap 3 is provided in this orbit and when the magnetic state in the accelerator core is changed, an accelerating magnetic field is generated in the accelerating gap 3 in accordance with the law of electromagnetic induction. The electrons are accelerated before their revolutions overlap by means of the accelerating magnetic field and become the high-energy electron beam 9. Then, the beam is taken out from the annular vacuum vessel 1. The extracted high-energy electron beam 9 is irradiated on the x ray conversion target 10 and is converted into x rays.

Next, a method of applying the accelerating magnetic field induced by the accelerating gap 3 will be explained. The beam accelerator of the present invention is a betatron accelerating system in which, by passing revolving electrons between accelerating phases of an alternating electric field of the accelerating gap 3 a number of times, the electrons obtain high energy. Injection to ejection is completed within one (1) cycle of the alternating electromagnetic field.

An amount of change in the magnetic state (flux) inside the accelerator core 4 depends on the core material. If a core material having a high saturation magnetic flux density is used, cross-sectional area of the core may be reduced, and, since the (amount of) core material is also reduced, diameter of the annular vacuum vessel 1 may be decreased, the size may be reduced and the cost may also be lowered. In the present embodiment, heat generation of the accelerator core 4 is controlled by using a soft magnetic material 50 $\mu$m or less in thickness, which has a small core loss and a large magnetic flux density at high frequencies. Accordingly, operation at a high exciting frequency of 1 kHz or more applied to the accelerator core 4 becomes possible.

In the present embodiment, any of the following (1), (2), (3) may be used as the high saturation magnetic flux density material used in the accelerator core 4. By using these materials, it is possible to control heat generation.

(1) Ferrous Amorphous

An article, including an insulating layer, substantially shown by general formula: FeaMbYc (in the formula, M is at least one (1) element selected from a rare earth element group of Ti, V, Cr, Mn, Co, Ni, Zr, Nb, Mo, Hf, Ta, W, Re, Ga, Ru, Rh, Pd, Os, Ir; Pt; Y denotes at least one (1) element selected from a group of Si, B. P; $65 \leqq a \leqq 85$, $0 \leqq b \leqq 15$, $5 \leqq c \leqq 35$, each number is at %);

(2) Ferrous Nano-crystal

An Fe-based soft, magnetic alloy, including an insulating layer, of a composition shown by a general formula: (Fe1-aMa)100-X-Y-Z-$\alpha$CuXSiYBZM1$\alpha$ (atomic percent) (however, M is Co and/or Ni; M1 is at least one (1) element selected from a group of Nb, W, Ta, Zr, Hf, Ti and Mo; a, X, Y, Z and $\alpha$ are $0 \leqq a < 0.5$, $0.1 \leqq X \leqq 35$ $0 \leqq Y \leqq 30$ $0 \leqq Z \leqq 25$, $5 \leqq Y+Z \leqq 30$ and $0.1 \leqq \alpha$ 30, respectively), in which at least 50% of the composition is fine crystal particles of an average particle diameter of 1 $\mu$m and a remaining portion of any of an amorphous material and the fine crystal particles or an amorphous material; or An Fe-based soft, magnetic alloy, including an insulating layer, of a composition shown by a general formula: (Fe1-aMa)100-X-Y-Z-$\alpha$-$\beta$CuXSiYBZM1$\alpha$M2$\beta$ (atomic percent) (however, M is Co and/or Ni; M1 is at least one (1) element selected from a group of Nb, W, Ta, Zr, Hf, Ti and Mo; M2 is at least one (1) element selected from a group of V, Cr, Mn, Al, platinum group elements, S, c, Y, rare earth elements, Au, Zn, Sn, Re; a, X, Y, Z $\alpha$ and $\beta$ are $0 \leqq a \leqq 0.5$, $0.1 \leqq X \leqq 3$, $0 \leqq Y \leqq 30$, $0 \leqq Z \leqq 25$, $5 \leqq Y+Z \leqq 30$ and $0.1 \leqq \alpha \leqq 30$ and $\beta \leqq 10$, respectively), in which at least 50% of the composition is fine crystal particles of an average particle diameter of 1 $\mu$m and a remaining portion of any of an amorphous material and the fine crystal particles or an amorphous material; or An Fe-based soft, magnetic alloy, including an insulating layer, of a composition shown by a general formula: (Fe1-aMa)100-X-Y-Z-$\alpha$-$\gamma$CuXSiYBZM1$\alpha$X$\gamma$ (atomic percent) (however, M is Co and/or Ni; M1 is at least one (1) element selected from a group of Nb, W, Ta, Zr, Hf, Ti and Mo; X is at least one (1) element selected from a group of C, Ge, P, Ga, Sb, In, Be, As; a, X, Y, Z $\alpha$ and $\gamma$ are $0 \leqq a \leqq 0.5$, $0.1 \leqq X \leqq 3$, $0 \leqq Y \leqq 30$, $0 \leqq Z \leqq 25$, $5 \leqq Y+Z \leqq 30$ and $0.1 \leqq \alpha \leqq 30$ and $\gamma \leqq 10$, respectively), in which at least 50% of the composition is fine crystal particles of an average particle diameter of 1 $\mu$m and a remaining portion of any of an amorphous material and the fine crystal particles or an amorphous material; or An Fe-based soft, magnetic alloy, including an insulating layer, of a composition shown by a general formula: (Fe1-aMa)100-X-Y-Z-$\alpha$-$\beta$-$\gamma$CuXSiYBZM1$\alpha$M2$\beta\gamma$ (atomic percent) (however, M is Co and/or Ni; M1 is at least one (1) element selected from a group of Nb, W, Ta, Zr, Hf, Ti and Mo; M2 is at least one (1) element selected from a group of V, Cr, Mn, Al, platinum group elements, S, c, Y, rare earth elements, Au, Zn, Sn, Re; X is at least one (1) element selected from a group of C, Ge, P, Ga, Sb, In, Be, As; a, X, Y, Z and $\alpha$ and $\gamma$ are $0 \leqq a \leqq 0.5$, $0.1 \leqq X \leqq 3$, $0 \leqq Y \leqq 30$, $0 \leqq Z \leqq 25$, $5 \leqq Y+Z \leqq 30$, $0.1 \leqq \alpha \leqq 30$, $\beta \leqq 10$ and $\beta \leqq 10$, respectively) in which at least 50% of the composition is fine crystal particles of an average particle diameter of 1 $\mu$m and a remaining portion of any of an amorphous material and the fine crystal particles or an amorphous material; or (3) A silicon steel plate including an insulating layer or a polarized silicon steel plate of a layer 50 $\mu$m or less in thickness.

Here, characteristics of the material used in the accelerator core 4 will be explained.

Figure 7:
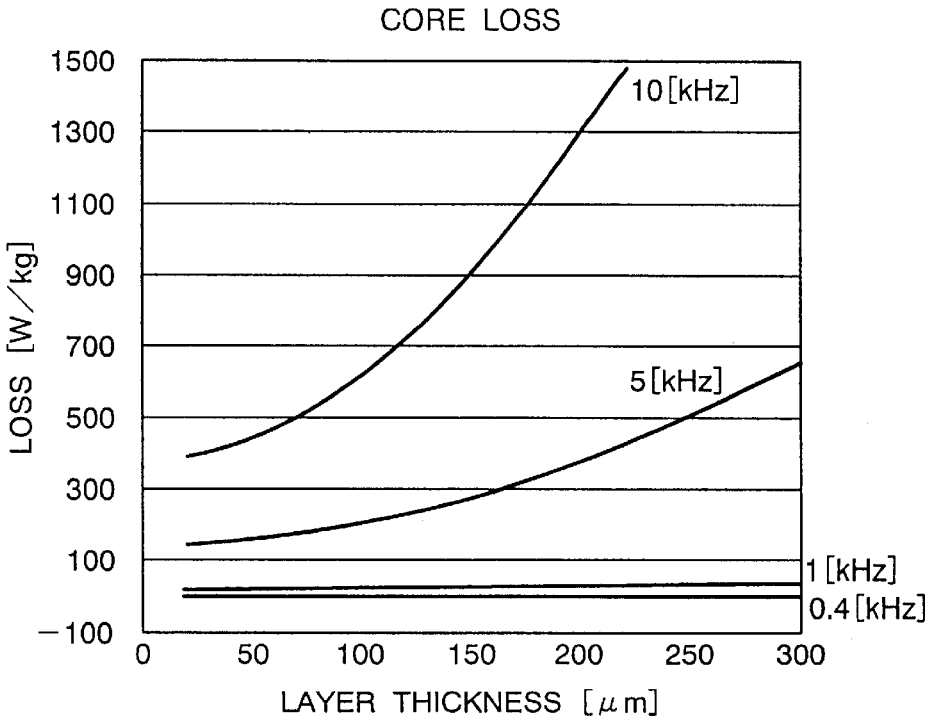
FIG.7 is a characteristics diagram of a material thickness in Embodiment 1.

First, regarding layer thickness:

The thicker a layer thickness of the material, the greater an eddy current loss, i.e., core loss, and there is a problem in that power consumption and heat generation are increased. FIG. 7 shows a characteristics diagram of material used in the present embodiment. FIG. 7 shows frequency as a parameter, where a vertical axis is loss and a horizontal axis is layer thickness, in a case where the accelerating core 4 is excited at 1 T.

According to the results in FIG. 7, the thicker the layer thickness, the greater the slope of the curve, that is, it is understood that loss quickly increases with an increase in frequency. Regarding operation of the accelerating core 4, because an accelerating voltage Vaccel is proportional to an exciting frequency f of the accelerating core 4, in order to increase the accelerating voltage of electrons it is absolutely necessary to make the exciting frequency a high frequency. Therefore, concerning frequency increase, it is preferable that a material of a 50 $\mu$m or less layer thickness with a slow increase in loss be used.

Next, regarding exciting frequency of the accelerating core 4:

As shown in FIG. 7, even in the case where the layer thickness is 50 $\mu$m or less, there is hardly any increase in loss when the frequency is less than 1 kHz. Accordingly, it is understood that the soft, magnetic alloy used in the present invention is particularly advantageous in the case where the exciting frequency is 1 kHz or more.

Figure 8:
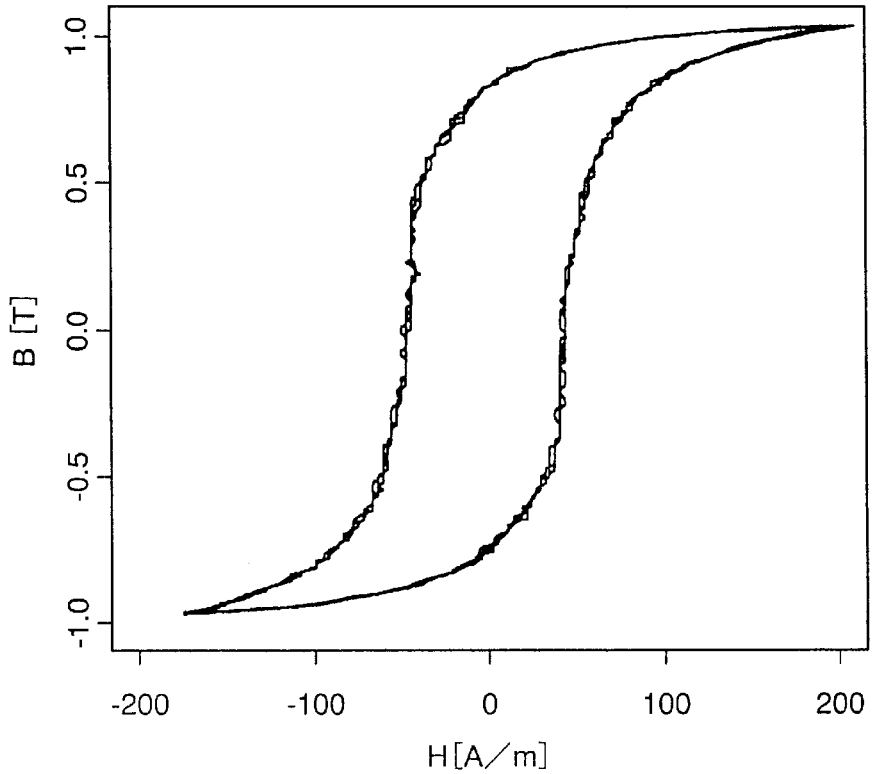
FIG. 8 is a relational diagram showing an accelerator core magnetic flux density—magnetomotive force curve in Embodiment 1.

Next, regarding saturation magnetic flux density:

Loss in the accelerator core 4 also changes in accordance with the saturation magnetic flux density used. FIG. 8 shows an accelerator core magnetic flux density—magnetomotive force curve (BH curve) in the present embodiment. In FIG. 8, the vertical axis shows a magnetic flux density B[T] and the horizontal axis shows a magnetomotive force H[A/m]. In the magnetic flux density—magnetomotive force curve of FIG. 8, loss in the accelerator core 4 corresponds to an area enclosed by the curves. Accordingly, when a low magnetic flux density is used, the area enclosed by the curves is reduced, and it is possible to reduce loss in the accelerator core 4. However, since the accelerating voltage Vaccel is proportional to a working magnetic flux density B of the, material, it is preferable that a high as possible flux density should be used. In fact, because exciting is done close to the saturation magnetic flux density of the BH curve(s) in FIG. 8, the core loss is also increased. In the case of this material, a Bmax is approximately 1 T. Accordingly, since there is a large core loss when a high magnetic flux density of 1 T or more is used, the present embodiment in which the soft, magnetic alloy of a saturation magnetic flux density of 1 T or more is used is particularly advantageous.

FIG. 9 is a relational diagram comparing working saturation magnetic flux density and loss in several materials. Regarding loss, the case is shown where the exciting frequency is 2 kHz and the magnetic density is 1 T; units are in W/kg. When considering reducing the size of the accelerator core, a ferrite of a low working saturation magnetic flux density is most disadvantageous and the other materials are approximately the same.

Although, from the point of view of loss, the ferrous amorphous, ferrous nano-crystal, silicon steel plate (50 $\mu$m) and silicon steel plate (100 $\mu$m) are preferable, in that order, from the point of view of cost, the ferrous nano-crystal ferrous amorphous, silicon steel plate (50 $\mu$m) are preferable, in that order, and silicon steel plate (50 $\mu$m) and silicon steel plate (100 $\mu$m) are approximately the same.

As described above, in the beam accelerator of the present embodiment, the accelerator core 4 is prepared by winding in multiple layers the ribbon-shaped material of the soft magnetic alloy of 50$\mu$m or less and a saturation magnetic flux density of 1 T or more. Thus, core loss may be controlled and the accelerator core may be reduced in size. Consequently, the size of the beam accelerator may be reduced and the cost may also be reduced.

Also, by applying an exciting frequency of 1 kHz or more to the accelerator core 4, the accelerating voltage may be increased and a high performance beam accelerator may be realized.

Still further, since deflecting electromagnet 2 (fixed magnetic field generating means) generates a fixed magnetic field which gradually goes from smaller to larger from an inside diameter-side to an outside diameter-side of the annular passage 1*a*, it is not necessary to change the magnetic field from the inner-side to the outer-side in synchronism with rotation of the charged particles; nevertheless, it is possible to simultaneously accelerate multiple charged particles circuiting a number of times in orbit. Also, the power source for supplying power to the deflecting electromagnet 2 may be simply changed from an expensive, high frequency power source to an inexpensive, general-purpose power .source and the cost may be reduced.

Furthermore, the magnetic field generating means (fixed magnetic field generating means) is the deflecting electromagnet(s) 2 including the pair of pole pieces 2*a*, 2*b* disposed facing each other so as to sandwich the annular passage 1*a* and gradually reduce the gap from an inside diameter-side to an outside diameter-side of the annular passage la. Hence, a fixed magnetic field which gradually becomes larger from an inside diameter-side to an outside diameter-side in the annular passage 1*a* may be easily generated.

Embodiment 2

Regarding an accelerator core, if a working volume is small, it is possible to control a gross heating value even when a material of a large core loss is used. Accordingly, in the present embodiment, heat generation is controlled by only using a material of a high saturation magnetic flux density in a portion of the accelerator core that is surrounded by the annular vacuum vessel which directly relates to the size of the beam accelerator.

Figure 10:
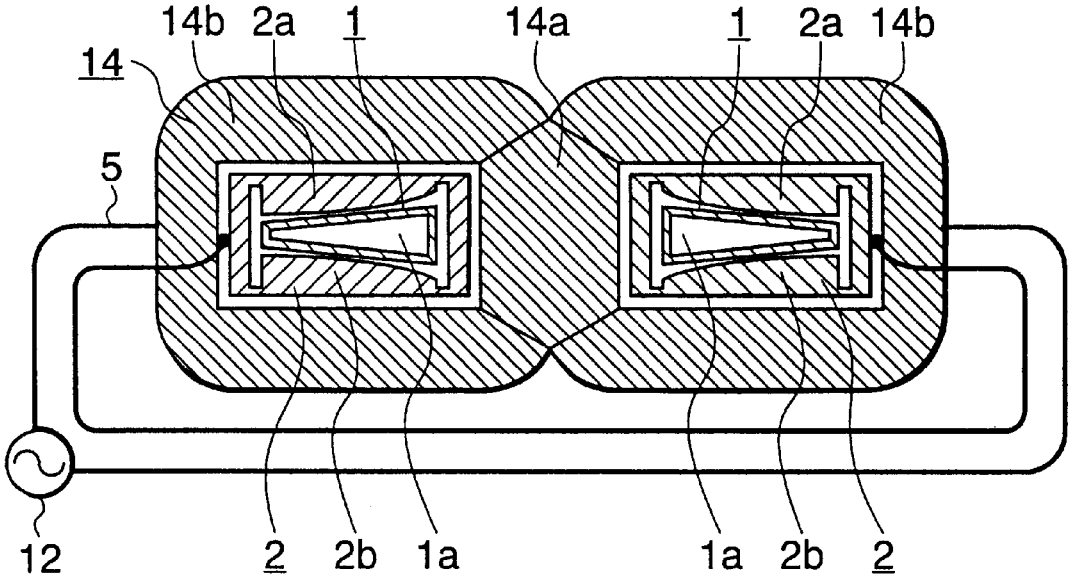
FIG. 10 is a cross-sectional drawing of an accelerator core of a beam accelerator of Embodiment 2 of the present invention.

FIG. 10 is a cross-sectional drawing of an accelerator core of a beam accelerator of Embodiment 2 of the present invention. In FIG. 10, an accelerator core 14 of the present invention includes an inner accelerator core 14*a* surrounded by the annular vacuum vessel 1 and an outer accelerator core 14*b* which is a c-shaped remaining portion. The outer accelerator core 14*b* is prepared by winding, in multiple layers, a ribbon-shaped material of a soft magnetic alloy 50 $\mu$m in thickness, similar to Embodiment 1, and, after making a square ring-shape, cutting away one (1) side portion of the square. On the other hand, the inner accelerator core 14*a* is prepared by winding, in multiple layers, a ribbon-shaped material of a soft magnetic alloy which is 5.0 $\mu$m in thickness and of a higher saturation magnetic flux density than the material used in the outer accelerator core 14*b*. Then, a single inner accelerator core 14*a* and two (2) outer accelerator cores 14*b* are joined to make the pair of accelerator cores 14 which are approximately eyeglass-shaped in cross section and which surround the annular vacuum vessel 1 in two (2) locations.

Moreover, in joining the outer accelerator core 14*b* and inner accelerator core 14*a*, a joining portion(s) is formed at approximately 45° and a joining surface(s) is polished to a predetermined mirror finish and both joining surfaces are joined by means of an adhesive and the like. The reason that the joining surfaces are polished as above is so that an adhesive layer impregnated between both joining surfaces may be extremely thin, and, as long as the adhesive layer is a predetermined thickness or less, magnetic flux is preferably generated in the accelerator core 14.

Also, in the outer accelerator core 14*b* and inner accelerator core 14*a*, a ratio between a saturation magnetic flux density Bo of the outer accelerator core 14*b* and a saturation magnetic flux density Bi of the inner accelerator core 14*a* is made to be equal to a ratio between a cross-sectional area Sd of the inner accelerator core 14*a* and a cross-sectional area Ss of the outer accelerator core 14*b* (Bo:Bi=Sd:Ss). By joining as above, thresholds of both saturation magnetic flux densities may be made the same and both the inner accelerator core 14*a* and outer accelerator core 14*b* may be designed using a safety factor (generally, 0.7 to 0.9) applied to the saturation magnetic flux density. Moreover, it is possible to adjust the joining surface area Ss by varying the inclination of the joining surface.

In the present embodiment, since the saturation magnetic flux density of the inner accelerator core 14*a* is high, an accelerator core sectional area for obtaining the necessary magnetic flux may be reduced, the size and weight of the beam accelerator may be reduced and the cost may also be reduced. On the other hand, because the volume of the inner accelerator core 14*a* does not exceed ¼ to ⅕ of the entire accelerator core volume, the gross amount of generated heat may be controlled.

In beam accelerator constructed such as above, the accelerator core 14 comprises an inner accelerator core 14*a* which is a portion enclosed inside radial directions extending from an inside side-surface of the annular hollow vessel 1 and an outer accelerator core 14*b* of a c-shaped cross section and forming a ring together with the inner accelerator core 14*a*, and the inner accelerator core 14*a* is made of a soft magnetic alloy of a higher saturation magnetic flux density than the outer accelerator core 14*b*. That is, because the soft magnetic alloy of high saturation magnetic flux density is used for the portion of the accelerator core 14 surrounded by the annular vacuum vessel 1 and the soft magnetic alloy of small core loss is used for the other remaining portion, it is possible to control loss (heat generation) in the entire accelerator core 14, a power source load may be reduced and a cooling construction may be simplified, and, at the same time, the size of the accelerator core may be reduced without increasing the cost.

Moreover, in the present embodiment, the fixed magnetic field generating means is not limited to that similar to the deflecting electromagnet 2 and similar effects may be obtained with other magnetic field generating means, for example, alternating magnetic field generating means and the like.

What is claimed is:

1. A beam accelerator comprising:

an annular hollow vessel having an annular passage inside, through which a charged particle beam passes, a plurality of fixed magnetic field generating means for deflecting the charged particle beam and guiding the charged particle beam into an orbit in said annular passage, located along a circumferential direction of said annular hollow vessel, an accelerating gap for inducing an accelerating electric field in the charged particle beam, located at a position of said annular hollow vessel, and an accelerator core, surrounding said annular hollow vessel, for generating the accelerating electric field via said accelerating gap by changing magnetic state of an inner portion of said annular passage in accordance with electromagnetic induction, wherein injection to ejection of charged particles is completed within one cycle of an excitation frequency applied to said accelerator core, and said accelerator core includes multiple wound layers of a ribbon-shaped soft magnetic alloy, 50 $\mu$m or less in thickness, and having a saturation magnetic flux density of at least one Tesla.

2. A beam accelerator comprising:

an annular hollow vessel having an annular passage inside, through which a charged particle beam passes, a plurality of magnetic field generating means for deflecting the charged particle beam and guiding the charged particle beam into an orbit in said annular passage, located along a circumferential direction of said annular hollow vessel, an accelerating gap for inducing an accelerating electric field in the charged particle beam, located at a position of said annular hollow vessel, and an accelerator core, surrounding said annular hollow vessel, for generating the accelerating electric field via said accelerating gap by changing magnetic state of an inner portion of said annular passage in accordance with electromagnetic induction, wherein injection to ejection of charged particles is completed within one cycle of an excitation frequency applied to said accelerator core, said accelerator core comprises an inner accelerator core enclosed inside radial directions extending from an inside side-surface of said annular hollow vessel and an outer accelerator core having a c-shaped cross section and forming a ring with said inner accelerator core, and said inner accelerator core is a soft magnetic alloy having a higher saturation magnetic flux density than said outer accelerator core.

3. The beam accelerator according to claim 2 wherein, in said outer accelerator core and said inner accelerator core, a ratio between saturation magnetic flux density of said outer accelerator core and saturation magnetic flux density of said inner accelerator core is equal to a ratio between cross sectional area of said inner accelerator core and joining area of said inner accelerator core and said outer accelerator core.

4. The beam accelerator according to claim 1 wherein said accelerator core has an excitation frequency of at least 1 kHz.

5. The beam accelerator according to claim 1 wherein said fixed magnetic field generating means generates a fixed magnetic field which gradually becomes larger from an inside diameter-side to an outside diameter-side in said annular passage.

6. The beam accelerator according to claim 5 wherein said fixed magnetic field generating means is an electromagnet comprising a pair of pole pieces facing each other and sandwiching said annular passage and which gradually reduce a gap from an inside diameter-side to an outside diameter-side of said annular passage.

7. The beam accelerator according to claim 1 wherein said magnetic field generating means generates a magnetic field which gradually becomes larger from an inside diameter side to an outside diameter side in said annular passage.

8. The beam accelerator according to claim 7 wherein said magnetic field generating means is an electromagnet comprising a pair of pole pieces facing each other and sandwiching said annular passage and which gradually reduce a gap from an inside diameter side to an outside diameter side of said annular passage.

* * * * *